United States Patent [19]

Bartow

[11] 4,401,191

[45] Aug. 30, 1983

[54] UPRIGHT FOR LIFT TRUCK

[75] Inventor: Richard J. Bartow, Athens, Mich.

[73] Assignee: Clark Equipment Company, Buchanan, Mich.

[21] Appl. No.: 176,742

[22] Filed: Aug. 11, 1980

Related U.S. Application Data

[63] Continuation of Ser. No. 28,291, Apr. 9, 1979, abandoned, which is a continuation-in-part of Ser. No. 17,779, Mar. 8, 1979, abandoned, which is a continuation-in-part of Ser. No. 842,765, Oct. 17, 1977, abandoned.

[51] Int. Cl.[3] ..... B66B 9/20

[52] U.S. Cl. ..... 187/9 E; 414/631

[58] Field of Search ..... 187/9 R, 9 E, 9 T; 414/629, 631, 641, 635, 785

[56] References Cited

U.S. PATENT DOCUMENTS 3,394,778 7/1968 Brinton ..... 187/9 E 3,830,342 8/1974 Allen ..... 187/9 E

FOREIGN PATENT DOCUMENTS 2020276 11/1971 Fed. Rep. of Germany ..... 187/9 R

OTHER PUBLICATIONS

Robinson; "Double Asymmetric Upright".

*Primary Examiner*—Joseph J. Rolla

*Assistant Examiner*—Kenneth Noland

*Attorney, Agent, or Firm*—J. C. Wiessler

[57] ABSTRACT

A truck upright sections, and a load carriage mounted on a telescopic upright section. A sole asymmetric lift cylinder assembly is located adjacent one side of the upright in a position which provides improved overall operator visibility through the upright. The lift cylinder is adapted to be operatively connected at its upper end to a first telescopic upright section for operating first lifting chain structure which traverses laterally across the upright and which is reeved on spaced and rotationally aligned sprockets supported from said telescopic section. The first lifting chain structure in all embodiments comprising either single or multiple chains has one chain end(s) fixedly secured a substantial distance outwardly of one side only of the cylinder assembly to a member, such as to the adjacent outer upright rail, and the other chain end(s) secured to the second telescopic section either centrally thereof or at opposite sides thereof.

A third telescopic upright section on which is mounted the load carriage is itself mounted for elevation relative to the second telescopic section. Second lifting chain structure is also adapted to traverse laterally across a portion of the upright and is supported from the second telescopic section by sprocket means and is reeved thereon such that one chain end structure is secured to the third telescopic section and the other chain end structure is connected to the first telescopic section. A second lift cylinder is mounted centrally of the third section for elevating thereon a load carriage to a full free-lift position.

21 Claims, 15 Drawing Figures

FIG. 6
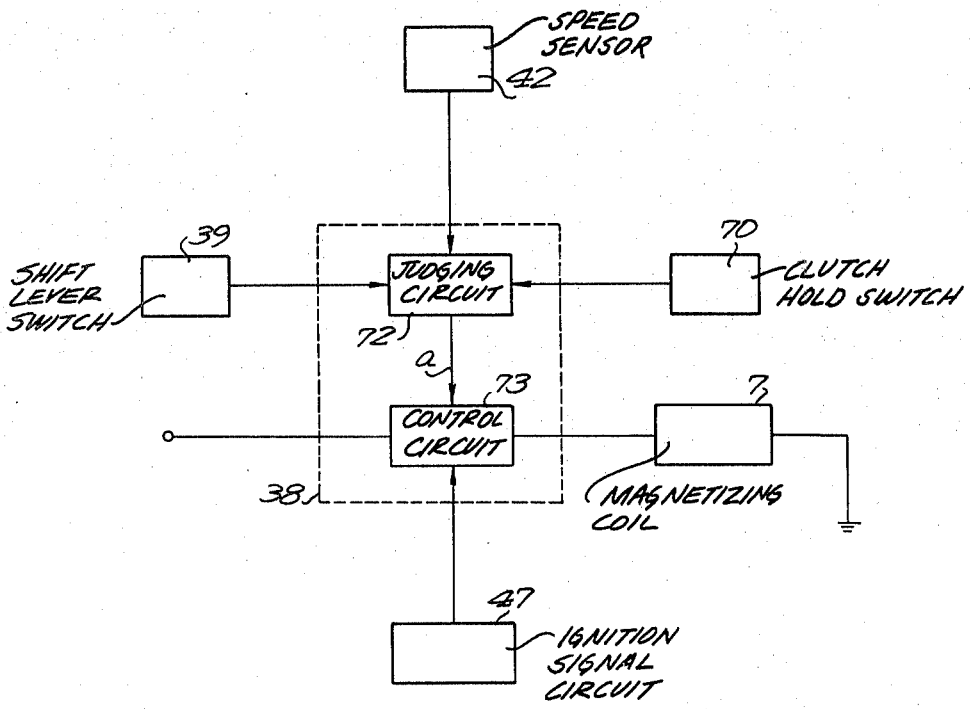
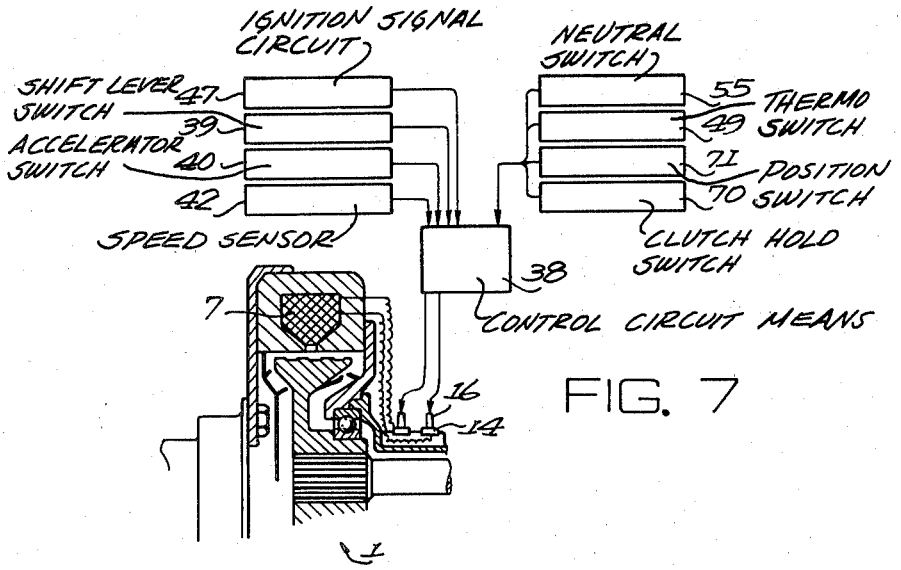
FIG. 7

UPRIGHT FOR LIFT TRUCK

CROSS REFERENCE TO RELATED APPLICATIONS

This application is a continuation of application Ser. No. 28,291, filed Apr. 9, 1979, now abandoned, which is a continuation-in-part of copending application Ser. No. 17,779, filed Mar. 8, 1979, now abandoned, which is a continuation-in-part of application Ser. No. 842,765, filed Oct. 17, 1977, now abandoned. The present application is also related to copending application Ser. No. 202,099, filed Oct. 30, 1980, which is a continuation of said application Ser. No. 17,779. The present application is in addition related to my commonly assigned, copending applications Ser. No. 28,292, Ser. No. 28,308, and Ser. No. 28,614, all filed on Apr. 9, 1979.

BACKGROUND OF THE INVENTION

In lift trucks of the type contemplated it has been one of the most persistent problems encountered in the art over the years to provide an upright construction which both affords the operator of the truck good visibility through the upright and which is of relatively simple and low cost construction, particularly in quad stage uprights. Heretofore various means have been devised for improving, or which may incidentally improve, operator visibility through telescopic uprights in lift trucks, including upright structures such as are disclosed in U.S. Pat. Nos. 2,394,458, 2,456,320, 2,855,071, 3,394,778, 3,830,342, and German Pat. Nos. 1,807,169 and 2,020,276, but none have satisfied adequately the above criteria.

SUMMARY

My present invention relates to a multi-stage upright having four or more stages. It provides in such an upright significantly improved operator visibility and relative simplicity and low cost construction. In particular my invention provides in an upright having three or more telescopic upright sections, a sole asymmetric lift cylinder assembly connected at its upper end to one of the telescopic sections and located adjacent one side of the upright in such a manner that it projects at least partially into the area of interference by the adjacent side of the upright when in a retracted or collapsed position with the visibility of an operator from his normal line of sight though that side of the upright, and preferably projects at least partially also into the longitudinal plane of that side of the upright. The cylinder operates first flexible lifting structure (chain means) which is reeved to traverse across a portion of the upright on rotationally aligned spaced sprockets or sheave (wheel) means supported from the one telescopic section, one end structure of the flexible lifing structure being fixedly secured outwardly of one side only of the cylinder assembly to a member, such as to the adjacent fixed upright rail, and the other end structure thereof being connected to a second telescopic upright section.

Second flexible lifting structure (chain means) which also is adapted to traverse laterally across a portion of the upright is supported from the second telescopic section by sprocket (wheel) means and is reeved thereon such that inner end structure of the flexible lifting structure is secured substantially centrally of the third telescopic section and the other end structure thereof is connected to the one telescopic section.

A cantilevered or second cylinder is mounted centrally of the third section for elevating thereon a load carrier or fork carriage to a full free-lift position, third flexible lifting structure being reeved on sprocket (wheel) means operated by the second cylinder and having one end of the flexible structure connected centrally of the load carrier and the other end thereof connected centrally of the third telescopic or inner upright section. A fluid pressure supply hose is connected between the base ends of the cylinder assemblies, being reeved in the upright in a generally double-S form for vertical movement with certain of the telescopic sections.

It is an important principle of the invention that the lifting forces of the asymmetric cylinder as applied through at least three telescopic sections and associated structure results in at least approximately balanced lifting force moments on the upright structure in the transverse plane of the upright.

It is a primary object of the invention to provide improved and novel upright structures having three or more telescopic upright sections for use on lift trucks and the like in which improved operator visibility is provided through the upright.

Another important object is to provide improved operator visibility in such upright structures while providing an upright of relative simplicity and low cost.

Other objects, features and advantages of the invention will readily appear to persons skilled in the art from the detailed description of the invention which follows.

DETAILED DESCRIPTION

Figure 1:
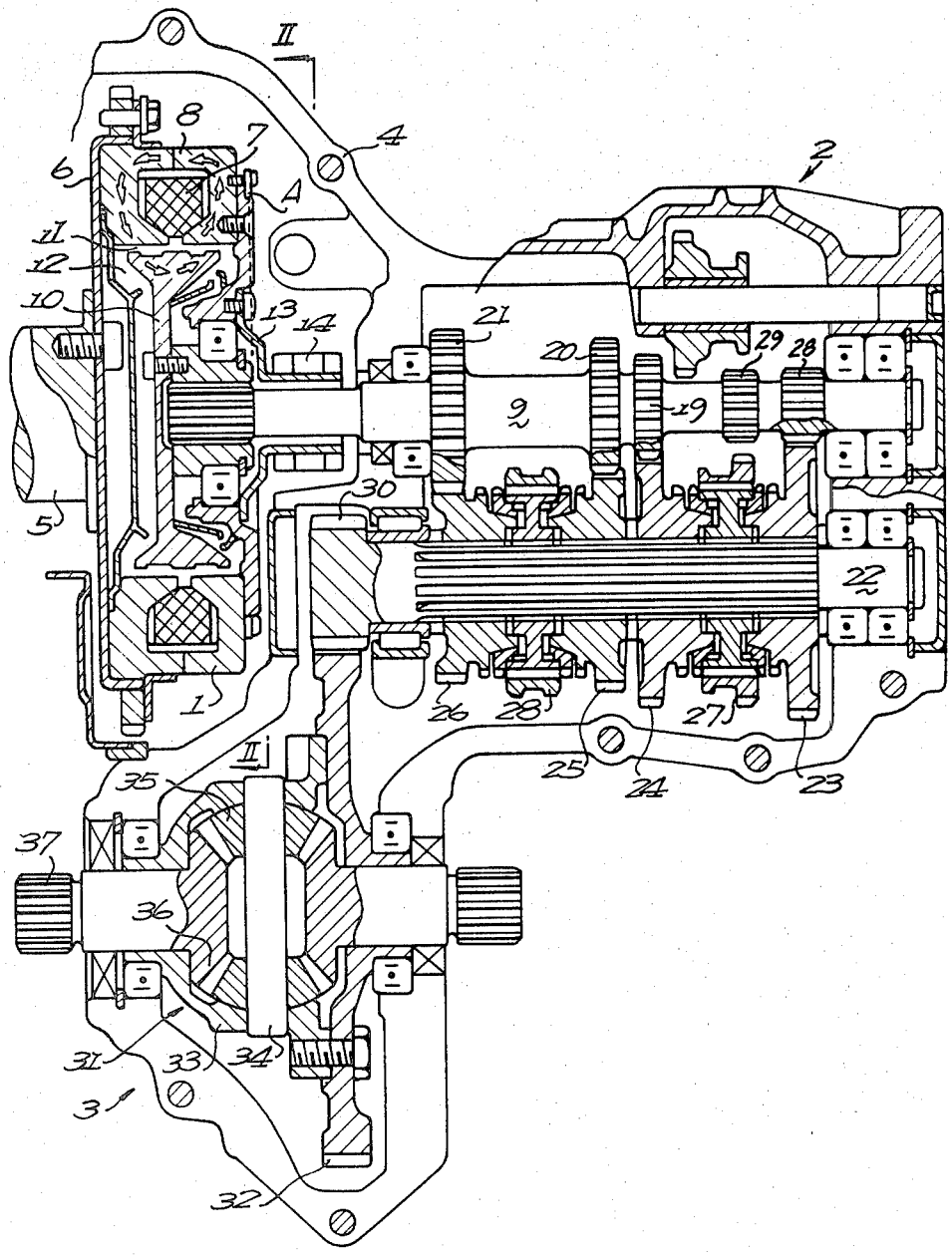
FIGS. 1A, 1B and 1C are a series of schematic figures which represent the positions of major components of the upright structure in three representative positions, viz, fully collapsed, at full free-lift, and at maximum fork height.
Figure 2:
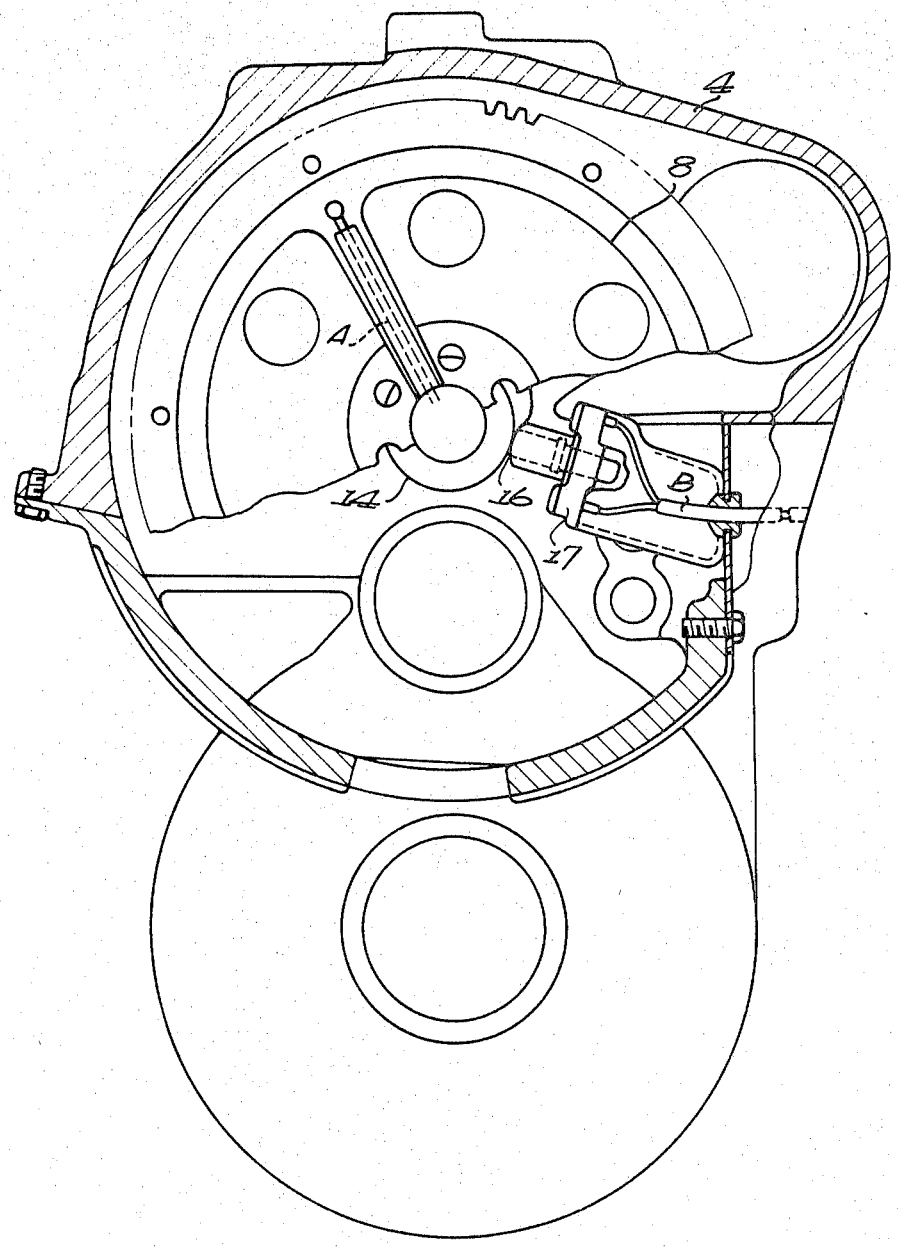
FIG. 2 is a full rear view in elevation of one embodiment of the upright in a collapsed condition.

Referring to the drawing and first to FIGS. 1–6, the upright assembly of the present invention is adapted to be mounted on a lift truck in known manner. A fixed mast section 20 includes a pair of transversely spaced opposed channel members 22 arranged to receive a first telescopic mast section 24 formed of two laterally spaced I-beams 26, which is in turn arranged to receive a second telescopic mast section 28 formed of two laterally spaced I-beams 30, which is in turn adapted to receive a third telescopic upright section 32 formed of two laterally spaced I-beams 34, each of the telescopic upright or mast sections being guide roller supported in the next adjacent outer mast section in known manner for longitudinal movement relative thereto. A load or fork carriage 36 having a pair of transverse support plates 35 and 37 is guide roller mounted by pairs of rollers 38 in the rails of the inner mast section 32 for elevation of the load carrier therein, the known pairs of guide roller means supporting each telescopic mast section in the next adjacent outer section not being shown herein.

Fixed mast section 20 is cross-braced for rigidity by upper and lower transverse brace members 40 and 42, section 24 being cross-braced by brace members 44 and 46, section 28 being cross-braced by upper and lower brace members 48 and 50, a mast section 32 being cross-braced by upper, middle and lower transverse braces 52,54 and 56. Additional particulars of the nested offset I-beam upright structure, the mounting of the load carriage thereon, and the like, are explained in the above identified parent copending application and in U.S. Pat. No. 3,213,967.

A primary cantilevered lift cylinder assembly 60 is supported centrally of inner upright section 32 on brackets 62 and 64 which are secured to the outer cylinder barrel, as by welding, and to the cross braces 54 and 56. A single sprocket 66 is mounted for rotation by a bracket 68 at the end of the piston rod 70, a lifting chain 72 being reeved on the sprocket and secured at one end to an anchor plate 74 located on the cylinder, and at the opposite end secured centrally of carriage plate 37 by an anchor block 76. The lift cylinder assembly 60 is substantially one-half the length of the inner upright section and when extended actuates the load carrier or fork carriage 36 at a 2:1 ratio to a full free-lift position as shown in FIG. 1B prior to the elevation of the three telescopic upright sections by a secondary asymmetric hydraulic lift cylinder assembly 80 having a piston rod 82, shown in a position or partial extension in FIGS. 5 and 6.

Cylinder 80 is supported near the bottom from brace 42 by a collar 84 welded to the cylinder and bolted to the top edge of the brace member, the piston rod 82 being secured by a pair of recessed studs 86 to a flat plate member 88 which is welded along its rear edge to the rear surface of brace 44, thus supporting the cylinder assembly from the top and bottom portions. A chain anchor block 90 is secured centrally of brace 50 at an anchor connection 92 of a secondary lifting chain 94 which extends upwardly and over a pair of spaced sprockets 96 and 98, and then downwardly to a fixed anchor connection 100 located in predetermined space relation from the outer side of cylinder 80 on an anchor block 102 of a vertical plate member 104 which is secured, as by welding, to the inner surface of an adjacent side member 106 of brace 40. Sprockets 96 and 98 are mounted, as shown, in transverse spaced relation on stub shafts 107 and 108 which are secured to brace 44 of the first telescopic section.

A single relatively heavy chain 94 should suffice but it may sometimes be found preferable for safety reasons to use two or more smaller chains reeved as is chain 94 on modified single sprockets or on multiple side-by-side sprockets as desired. Recitations in the claims of "sole flexible lifting means", and the like include such multiple side-by-side lifting elements which will perform the same function as does the single lifting chain 94 as shown.

In order to substantially balance the force moments acting in the transverse plane of the embodiment of the upright assembly as disclosed, the connection of the chain to anchor block 90 should be located at or substantially at the transverse center or in the central vertical plane of mast section 28, and the connection of piston rod 82 to plate member 88 in combination with the location of chain anchor 100 should be such that the piston rod is connected to plate 88 at or near two-thirds of the distance towards the right side of the upright between the chain anchor locations as projected in the transverse plane of the upright. Then the forces passing through upright sections 20, 24, and 28 create either substantially no unbalanced moments or calculated small unbalanced moments in the transverse plane of the upright because the asymmetric cylinder assembly is so located in a multiple stage upright as described herein as I have found, between the said projected locations of the chain anchors. A more detailed explanation of the force moments effective in an upright as a result of the location and operation of the asymmetric cylinder assembly and sprocket and chain system will be found in my above-identified parent copending application in respect of a construction of an upright wherein the piston rod is located midway between such projected locations of the chain anchors. Of course, the force moments acting on the upright assembly in respect of the operation of central primary cylinder 60 are balanced.

A pair of tertiary chains 110 and 112 are mounted on sprockets 114 and 116, respectively, which are stub shaft mounted from brace 48 of mast section 28. The chains are transversely spaced and in parallel, the inner ends thereof being secured centrally or lower brace 56 of inner mast section 32 on an anchor plate 118 by anchors 120 and 122, and being secured at the outer ends to anchor members 124 and 126 (FIGS. 3 and 5) on cantilevered anchor blocks 128 and 130 which are secured and extend inwardly from the edges of the inner rear flange rails of mast section 24.

A hydraulic hose sheave 132 is mounted to rotate on the shaft of sprocket 116, it being adapted to receive a flexible pressure supply conduit 134 which is reeved in a double-S in the upright between a pair of fluid junction blocks 136 and 138 mounted from the base of cylinders 80 and 60, respectively, and which are connected to hose 134 and to each other by non-flexible conduits 140 and 142. One section of hose is located preferably in the vertical central plane of the upright while the other section is guided in a pair of spaced vertical guide members 144 and 146 mounted from the mast sections 24 and 20, respectively, (FIGS. 4 and 5) for guiding movements of the hose in known manner. It will be noted that the vertical hose sections tend to nest behind other parts of the upright assembly, such as the rail sections and the central chains and cylinder, thereby minimizing interference with operator visibility.

The upright is adapted to function in theoretical force moment balance. Of course, such theoretical conditions do not normally exist in practice, and side thrusts or torque loading on the upright such as result from unbalanced moments effected by off-center loads on the fork, for example, may be resisted by upper and lower pairs of carriage side thrust rollers operating on the outer flange edges of I-beams 34 in known manner (one transverse pair is shown at 150 in FIG. 3).

Figure 5:
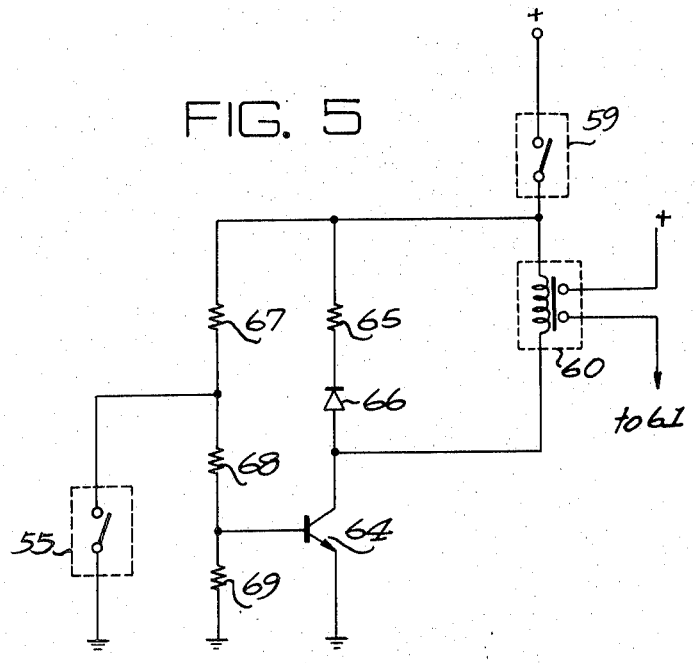
FIG. 5 is a view of the upright as in FIG. 2 but reduced in scale, with the telescopic sections partially elevated.
Figure 4:
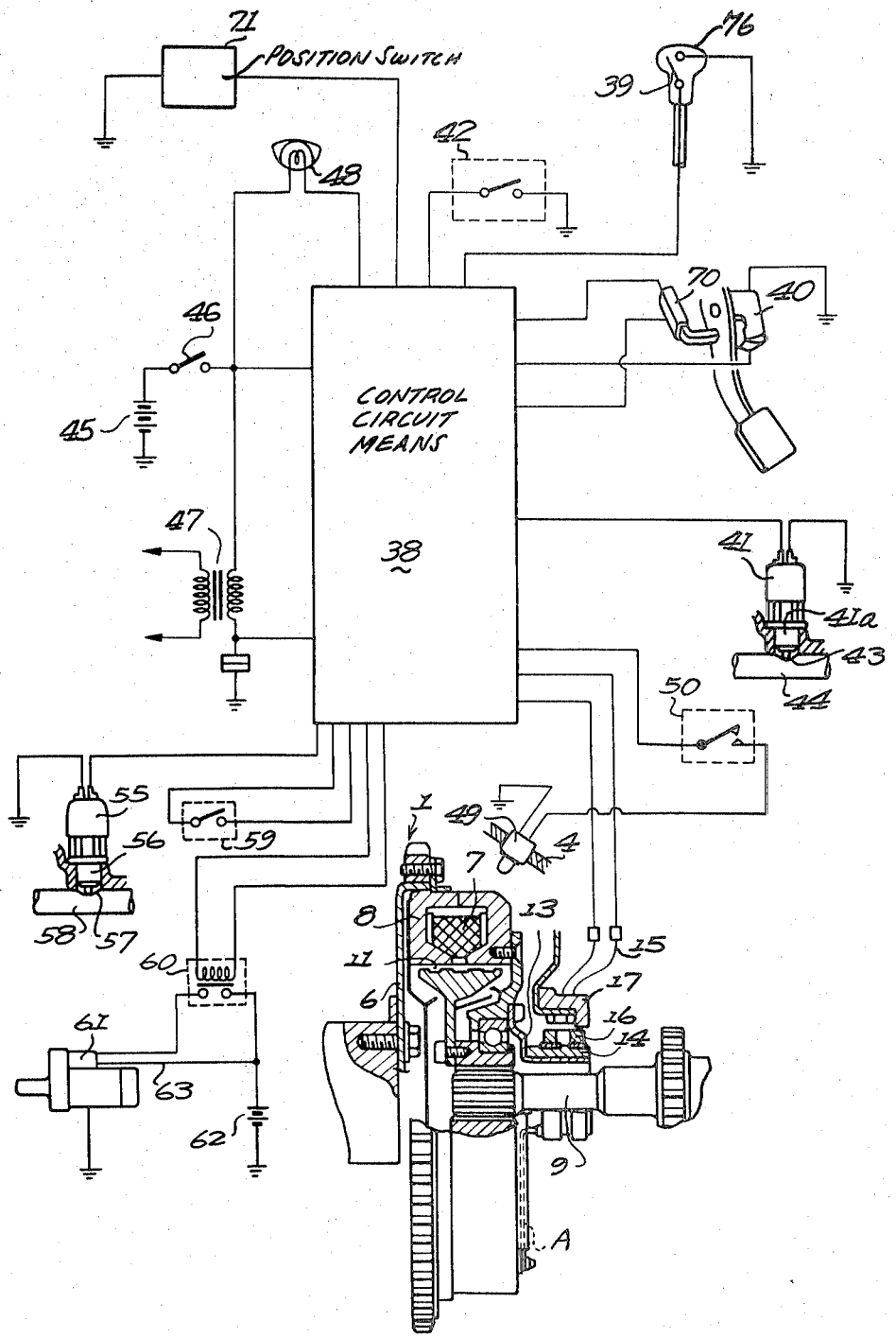
FIG. 4 is a sectional view thereof taken along line 4—4 of FIG. 2.
Figure 8:
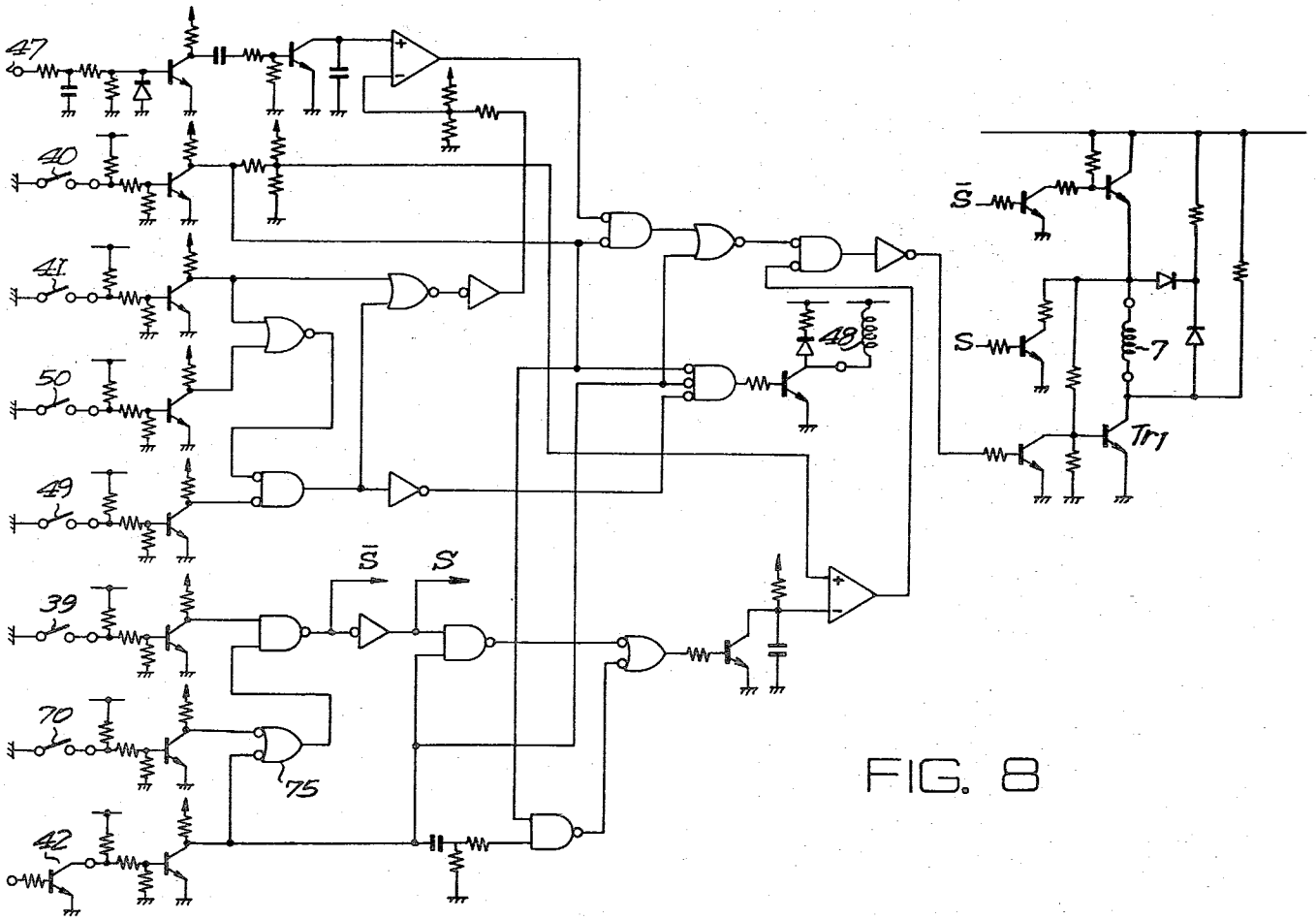
FIG. 8 is a full rear view in elevation of another embodiment of the upright in a collapsed condition.

It should be noted that the weight of the upright section 24 will impart a slight unbalanced moment in a counterclockwise direction as seen in FIG. 5, for example, on the asymmetric cylinder assembly 80, so that if desired the latter unbalanced moment may be compensated by adjusting the location of the cylinder assembly slightly inwardly of its said prior theoretically balanced position between the projected chain anchor locations 92 and 100. On the other hand any such inward adjustment of the cylinder assembly location may tend to interfere somewhat with maximum visibility through that side of the upright, depending upon the operator's normal transverse location on the truck and longitudinal distance from the upright. Also, any such unbalanced force moments are relatively minor and should in most upright designs be readily acceptable in the overall design, which usually includes some provision for resisting side thrust such as by pairs of side thrust rollers 150.

It will be apparent that the rest of the upright sections and the load carrier are substantially balanced in the transverse plane of the upright in the use of the center mounted cylinder assembly 60 and the centered and symmetrical mounting of chains 110, 112 and associated structure.

The designer of uprights of various widths and depths, truck seat locations, and the like, may choose any one of a number of viable combinations of such structure within the scope of my invention. It should therefore be understood that recitations in the claims hereof relating to the substantial or approximate balance of force moments in the upright, or to the asymmetric position of the cylinder substantially or approximately two-thirds the outward distance between the projected chain anchor locations or the like, shall be interpreted to include a range of positions of the cylinder assembly between the sprockets which best effects the desired result of good operator visibility through the upright and adequately balanced force moments acting on the upright in operation.

The design is such that the location of the cylinder assembly at one side of the upright combines with the location of the operator to provide an operator's line of sight through the upright on the side at which the asymmetric cylinder asembly is located so that said cylinder assembly interferes a relatively small amount or not at all with the operator's visibility through that side of the upright. In other words, the asymmetric cylinder assembly preferably projects substantially or entirely into the area of intereference by the adjacent side of the upright when in a retracted or collapsed position with with visibility of the operator from his normal line of sight through that side of the upright when the operator is located in a predetermined designed position and attitude for normal operation of the lift truck. I have found that in order to achieve most desirable results in terms of operator visibility, that cylinder 80 should be located such that it projects a distance into the aforementioned area of interference by the adjacent side of the retracted upright which is substantially equal to or greater than the diameter of the cylinder. In multi-stage uprights as described above it will be found that the asymmetric cylinder will in fact project a substantial distance into the longitudinal plane of the adjacent side of the upright, or project entirely into said plane as is in fact the structure of the embodiments of the invention described herein.

References made in the specification and claims hereof to the longitudinal plane of one side of the upright, or of the vertical rails of the upright, or terms of similar import, shall have the following meaning: The longitudinal plane of the one side of the upright shall mean a vertical plane extending longitudinally of the upright assembly bounded by the outer and inner surfaces of the vertical rail assembly on one side of the upright.

Figure 1C:
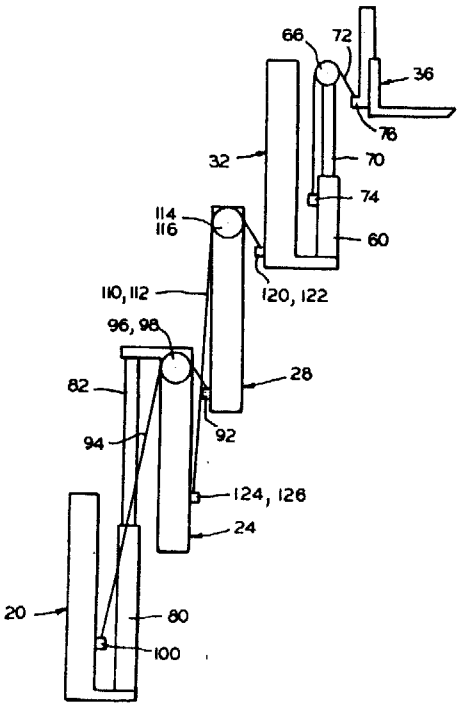
Figure 1A:
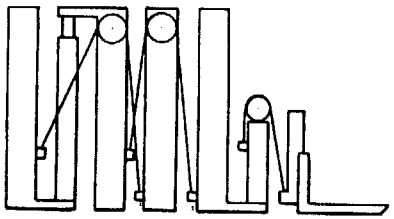
Figure 1B:
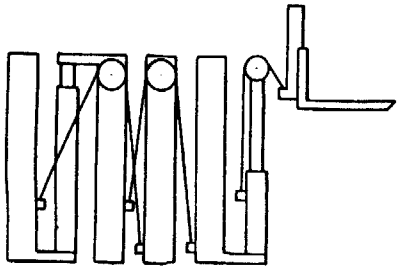
Figure 2:
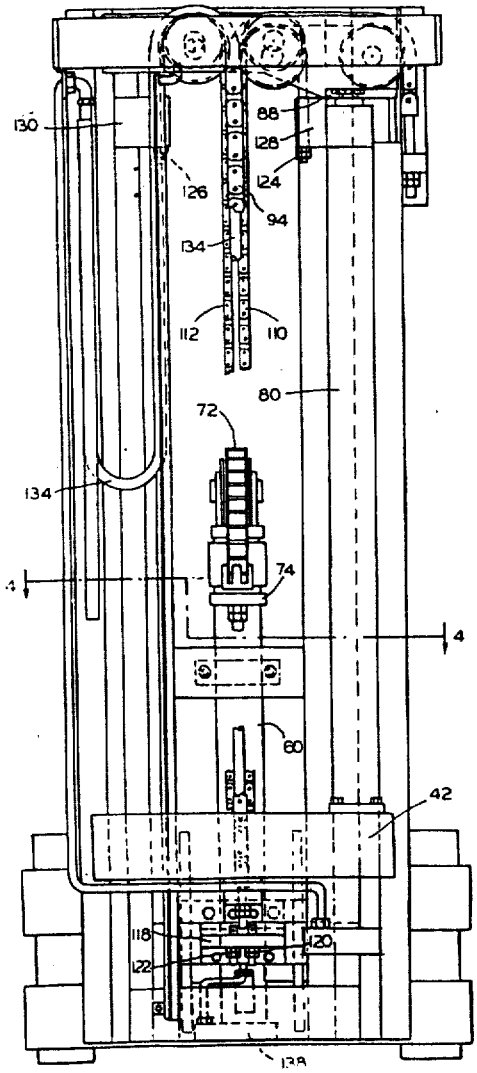
Figure 5:
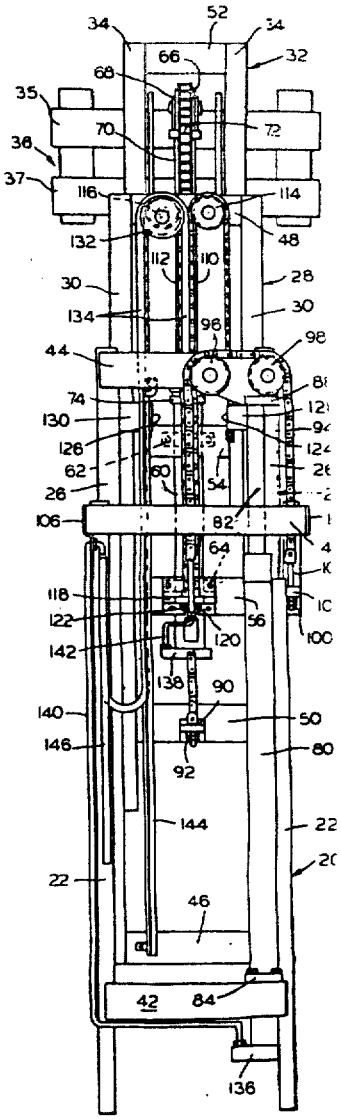
Figure 3:
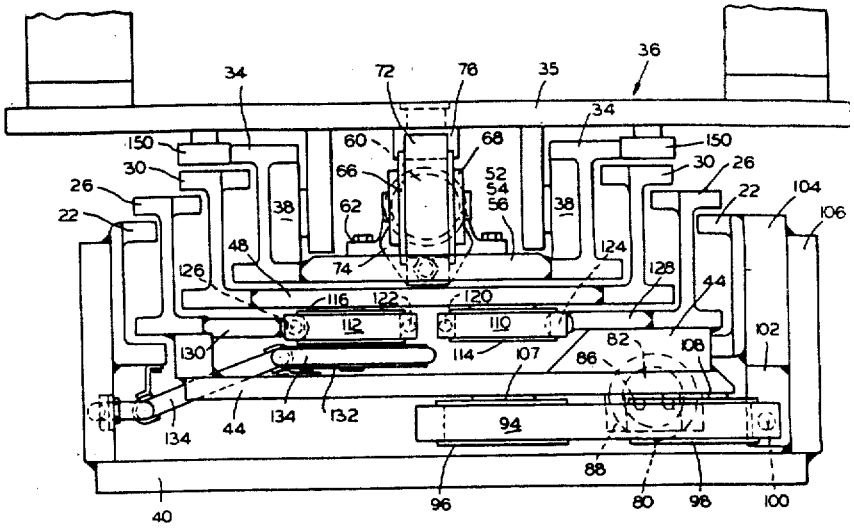
Figure 4:
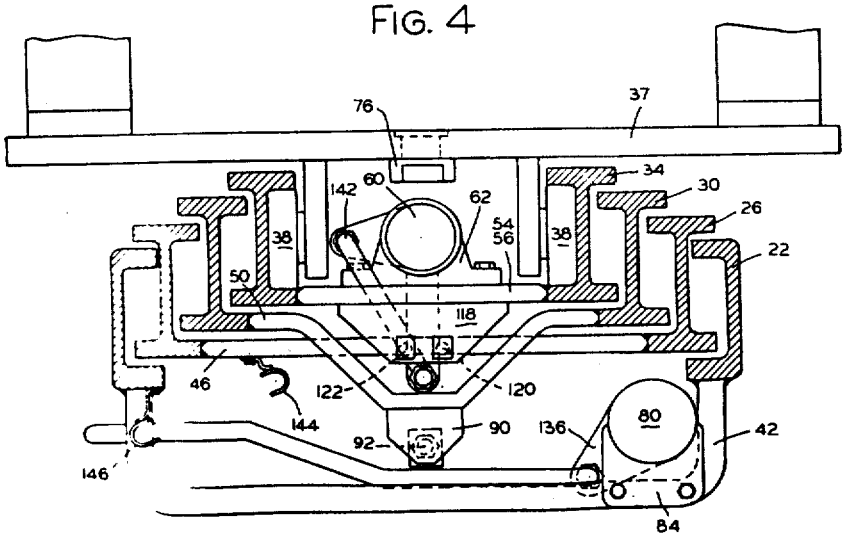
Figure 6:
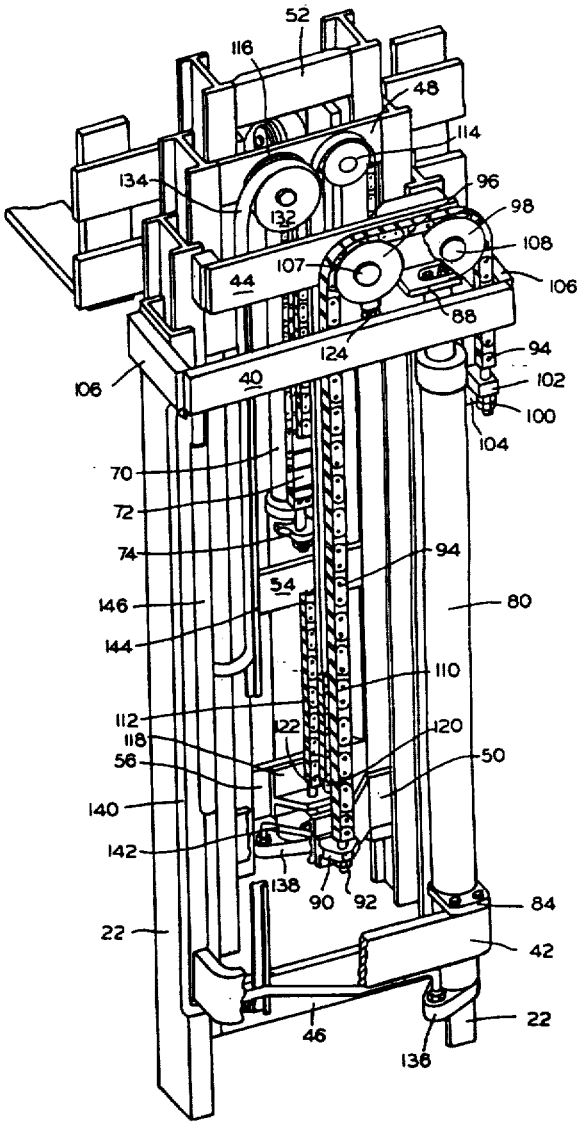
FIG. 6 is a perspective view of the upright in a condition of partial elevation.

In operation, to elevate the upright from the position in FIG. 1A to that in FIG. 1C pressure fluid is delivered by a hydraulic system simultaneously to cylinder assemblies 60 and 80 and, as is known, the cylinders operate automatically in the sequence related to the load supported thereby, whereby cylinder 60 functions initially to elevate load carrier 36 in mast section 32 to the full free-lift position illustrated in FIG. 1B at a 2:1 ratio to the movement of piston rod 70. At the termination of this initial stage of operation the pressure fluid automatically sequences asymmetric cylinder 80 to elevate the entire telescopic upright structure in outer mast section 20 from the FIG. 1B position to the FIG. 1C position while the load carrier is maintained by cylinder 60 in the aforementioned free-lift position; i.e., by the direct connection of cylinder assembly 80 to mast section 24 and to second telescopic section 28 by chain 94 and by the indirect connection thereof to third telescopic section 32 by the connection of pairs of chains 110 and 112 between sections 24 and 32 and by way of sprockets 114 and 116 on section 28. It will be apparent to persons skilled in the art that the chain reeving effects a 2:1 movement ratio as between each rail section and the next succeeding adjacent rail section, such that full extension of the asymmetric cylinder assembly 80 effects an extension of the upright structure from the position shown in FIG. 1B to that in FIG. 1C.

Lowering of the upright is effected by venting the cylinders to the fluid reservoir, whereby a reversal of the above-mentioned sequencing occurs as cylinder assembly 80 first fully retracts to the position of FIG. 1B, subsequent to which cylinder assembly 60 retracts the load carrier to the FIG. 1A position.

Figure 3:
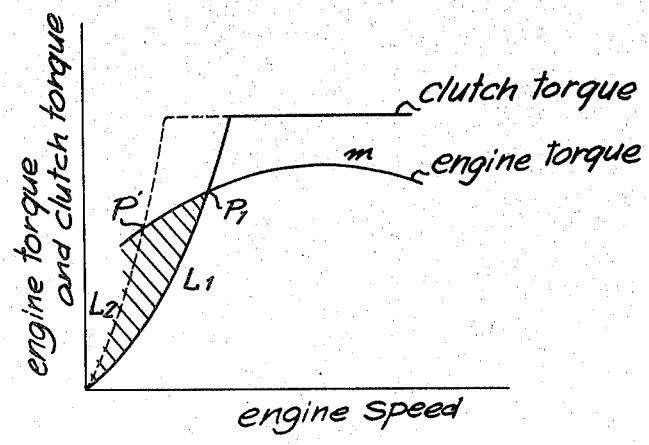
FIG. 3 is a plan view of the upright.
Figure 7:
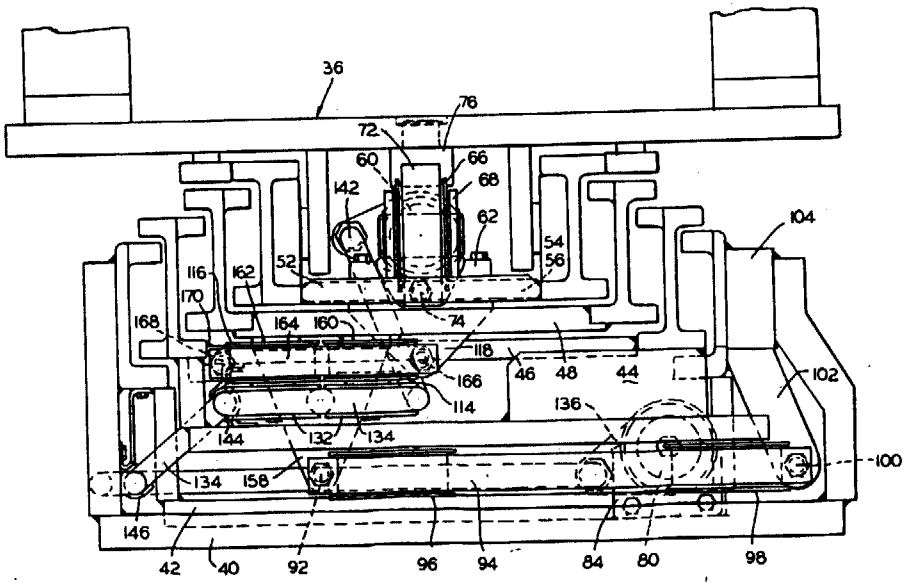
FIG. 7 is a plan view of a modified version of the upright of FIGS. 2–6.
Figure 8:
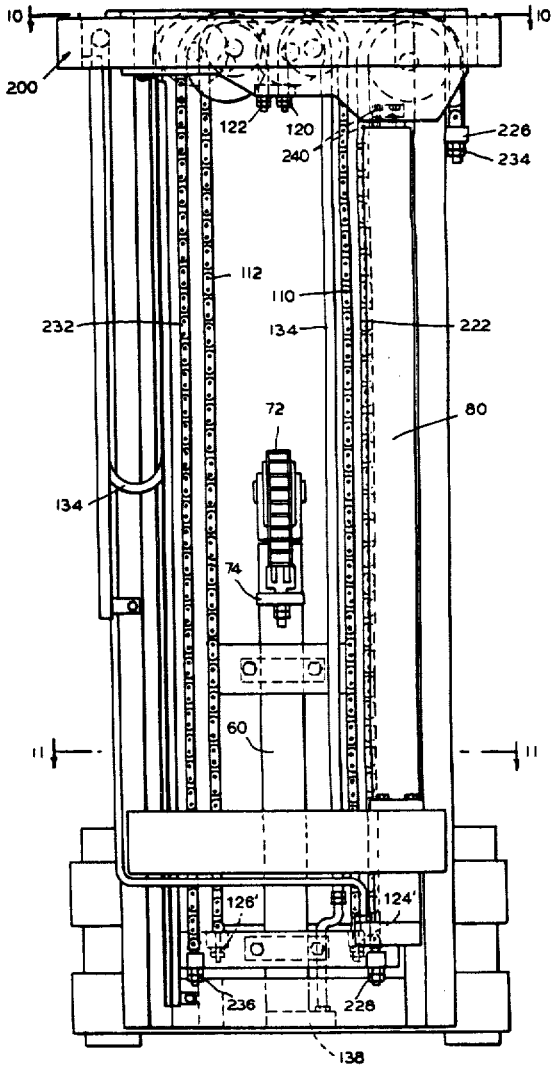
Figure 9:
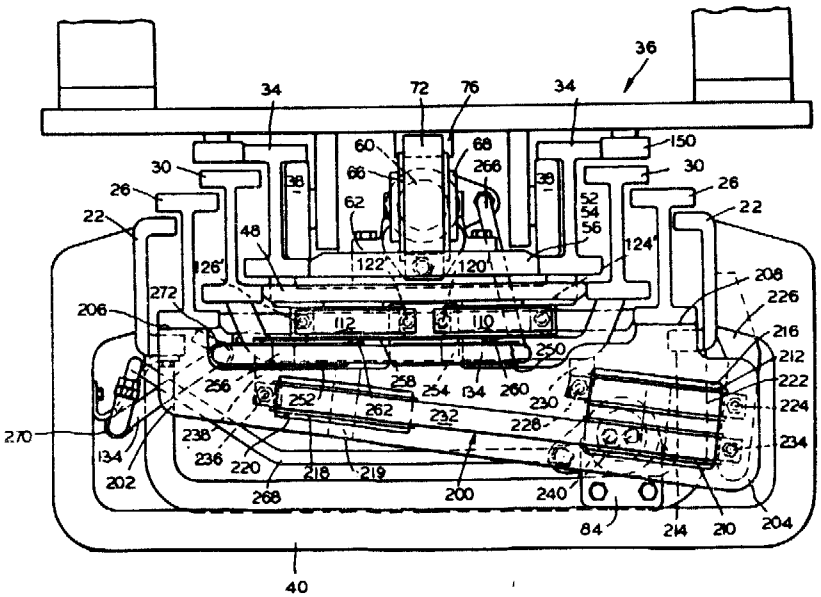
FIG. 9 is a plan view of the modified embodiment.
Figure 10:
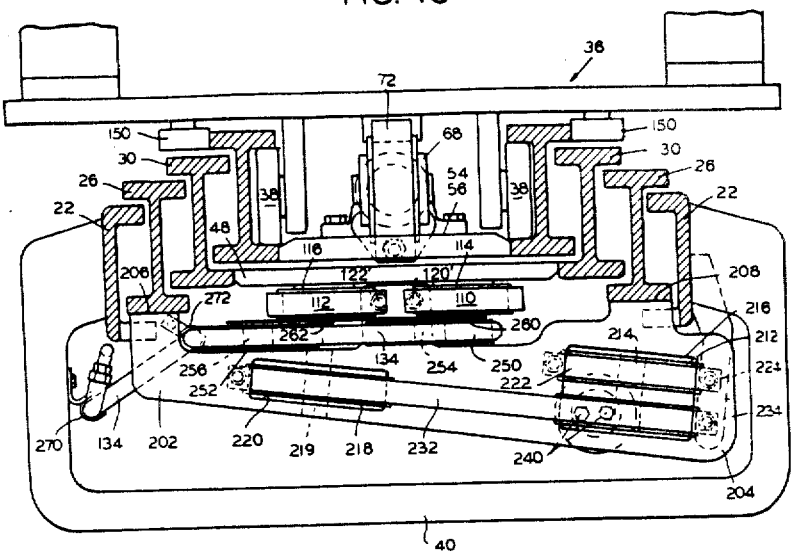
FIG. 10 is a sectional view taken along line 10—10 of FIG. 8.
Figure 11:
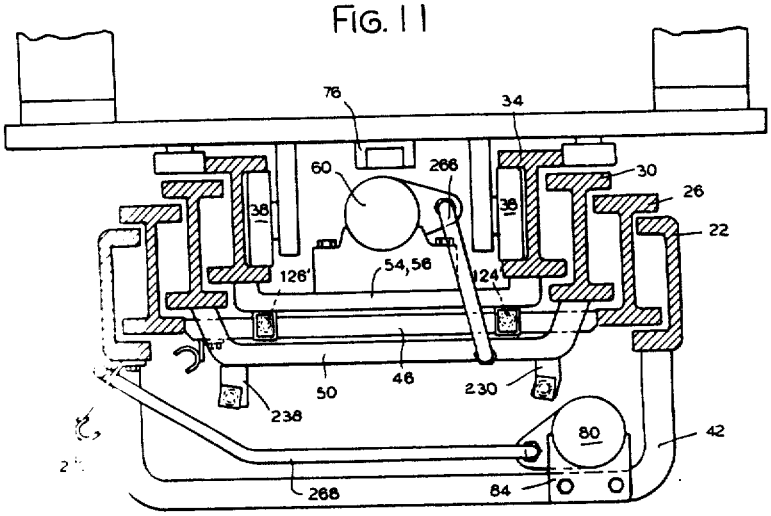
FIG. 11 is a sectional view taken along line 11—11 of FIG. 8.
Figure 12:
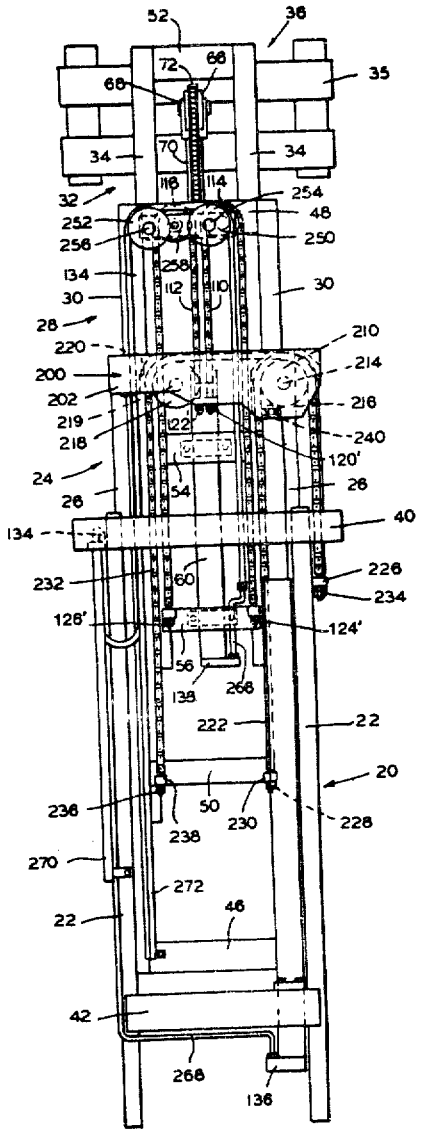
FIG. 12 is a view of the upright of FIG. 8, reduced in scale, with the telescopic sections partially elevated.
Figure 13:
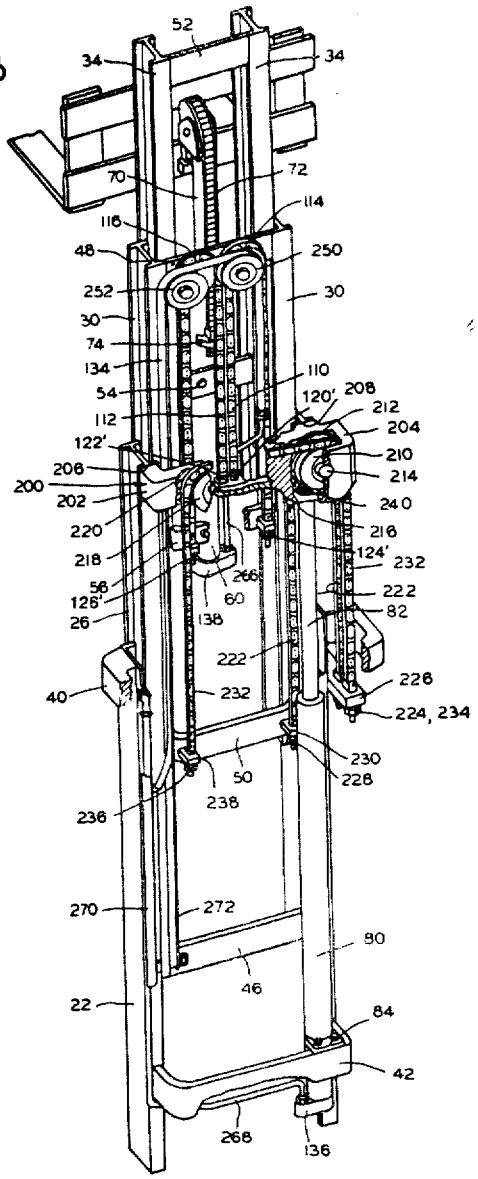
FIG. 13 is a perspective view of the upright in a condition of partial elevation with certain parts broken away.

Referring now to the modification shown in FIG. 7 wherein similar parts have been numbered the same as in FIG. 3, modifications of main significance comprising the relocation of the pairs of sprockets 96 and 98 and of 114 and 116. In FIG. 7 sprockets 96 and 98 are spaced transversely at a substantially greater distance apart than in the first embodiment wherein inner anchor 92 of chain 94 is located in the vertical central plane of the upright to provide a close-coupled relationship between the sprockets and the asymmetric cylinder. In the modification, as will be observed, the sprockets are spaced so that anchor 92 is located not centrally of the upright but towards the opposite side thereof, it being centered in a vertical longitudinal plane which extends midway between sprockets 114 and 116 which are mounted on stub shafts 160 and 162 which are supported from brace 48 of the second telescopic section. The shafts also support a pair of hydraulic hose sheaves 132 concentric with sprockets 114 and 116. A single chain 164 is reeved on sprockets 114 and 116; the inner end is secured to a centrally located anchor 166 mounted on a cantilevered anchor block 118 which is connected to brace 56 of the third telescopic section, and the outer end is anchored at 168 to the one rail of mast section 24 by an anchor block 170.

The operation of the modified structure is the same as described above, the structure of the first embodiment being preferred as providing better visibility than the modified structure. The upright may be theoretically balanced in the transverse plane thereof because asymmetric cylinder 80 is located approximately two-thirds of the transverse distance between the central vertical plane of load carrier 36 and chain anchor 100 towards the right side of the upright. Chain 94 is operated thereby, anchor 166 of chain 164 being in the central vertical plane of load carrier 36, and anchor 92 being projected midway between anchors 166 and 168.

Referring now to the modified embodiment shown in FIGS. 8–13, many of the parts are the same or similar to those shown in FIGS. 2–6 and those parts have been numbered the same as in that embodiment. New parts are identified by new numbers.

As will become apparent from an examination of FIGS. 8–13, the structure is essentially similar to the structure of FIGS. 2–6, except for the chain reeving, mounting and sprocket structure associated with the asymmetric cylinder assembly, the locations of the anchor connections of chairs 110 and 112, and the reeving and mounting of the hydraulic hose and sheave structure which connects the bases of the two lift cylinder assemblies. The description which follows will relate only to the above modified structure, the remaining structure of the upright being apparent from the embodiment of FIGS. 2–6 and from the numbering of similar parts as applied to the structure of FIGS. 8–13.

As illustrated, a transverse brace and sprocket support member 200 is formed in the particular showing thereof to have a relatively narrow end portion 202 and a relatively wide end portion 204, the member being secured at 206 and 208 to the upper ends of the rear flanges of I-beam rails 26. A pair of sprockets 210 and 212 are mounted for rotation on a shaft 214 in a slot or opening 216 of wide end 204, a second transversely spaced and rotationally aligned sprocket 218 being mounted on shaft 219 in a recess 220 at the narrow end 202 of brace 200. A first chain 222 is secured at anchor 224 to an anchor block 226 secured to the side of fixed rail 22 and reeved on the one sprocket 212. The chain extends down through opening 216 and is connected at its opposite end by an anchor 228 to a bracket 230 which is secured to the rear of the adjacent side of lower brace 50 of telescopic section 28. A second chain 232 is secured by an anchor 234 to anchor block 226 and is reeved as shown on sprockets 210 and 218 transversely across the upright and downwardly at the opposite side to an anchor 236 secured by a bracket 238 to the rear side of the remote end of brace 50.

In order to substantially balance the force moments acting in the transverse plane of this embodiment the connections of chains 222 and 232 to anchors 228 and 236 should be approximately equally spaced on opposite sides of the longitudinal central vertical plane of load carriage 30, and I have found that the location of the connection of the piston rod to brace and support member 200 by a pair of volts 240 should be at or near one-third of the sum of the projected or transverse distances from the said central plane of load carriage 30 to the two chain anchors 224 and 234. It should be noted that the relative locations and spacing either longitudinally or transversely of the upright of anchors 224 and 234 may be varied to suit design requirements so long as the above distance relationship between the connection of the piston rod to the telescopic section 24 and the sum of said transverse distances is maintained, whereby considerable design flexibility is possible in this respect.

In such a design the forces passing through the respective upright sections create substantially no unbalanced moments or a calculated small unbalanced moment in the transverse plane of the upright the result being similar to that explained above in respect of FIGS. 2–7.

Of course, again as in FIGS. 2–7, the weight of upright section 24 will impart a slight unbalanced moment on the asymmetric cylinder assembly which may be compensated by adjusting its location slightly inwardly of the upright as previously explained.

In all the embodiments hereof the forces passing through the respective upright sections create substantially no unbalanced moments, or create a calculated unbalanced moment in the transverse plane of the upright.

Hydraulic hose and sheave construction connecting the base ends of the cylinders and mounted from the upper end of telescopic section 28 is similar to that described in respect to the embodiment of FIGS. 2–6, but adapted for mounting in the dual chain construction of this embodiment as distinct from the single chain construction of the first embodiment operating between upright sections 20,24 and 28.

In the present embodiment a pair of transversely spaced hose sheaves 250 and 252 are mounted for rotation on stub shafts 254 and 256 which are support from a hose sheave mounting plate 258 which is connected to chain sprocket mounting pins 260 and 262. The flexible hose 134 is reeved on sheaves 250 and 252 transversely of the upright and is coupled at its opposite ends with tubing 266 and 268 mounted on the respective cylinder bases. The hose also is mounted in hose guides 270 and 272 mounted from the upright sections 20 and 24, respectively, similar to the previous embodiment for guiding movements of the hose in known manner. It will be noted that as previously the vertical hose sections tend to nest behind or adjacent to other parts of the upright assembly, namely the side rail section of the upright, thereby reducing interference with operator visibility.

The anchor connections of chains 110 and 112 are reversed from the connections thereof in FIGS. 2–6 and accordingly are designated by the same reference numerals primed. Connections 120′ and 122′ are spaced transversely outwardly or inner central anchor connections 124′ and 126′. The former are connected to the third telescopic section and the latter are connected to the first telescopic section. The reason for reversing said connections is to maintain good visibility through the upright.

The operation of the present embodiment is basically the same as in the operation of the embodiment of FIGS. 2–6 with reference to FIGS. 1A, 1B and 1C, the essential difference, as explained above, being in the dual chain and sprocket and associated structure which, of course, does not affect the sequence of operation as previously described.

It will be understood by persons skilled in the art that modifications and design variations in upright designs other than those described above may be found feasible without departing from the scope of my invention. For example, certain ones of the design variations described in my above copending application may be found feasible in multi-stage uprights of the type described above having four or more upright sections.

Depending upon such things as the axial distance of the operator from the upright, the width of the upright, and the transverse position of the operator when seated or standing in a normal operating position on different lift truck types, the most desirable precise location of the asymmetric cylinder assembly based upon the various factors may be established. As noted previously, the most critical combination of factors affecting the selection of the cylinder location is operator visibility and force moment balance on the upright, both of which may be compromised from the ideal within the scope of my invention as required to effect the most desirable combination.

However, before the particulars of any given upright design are finalized, it is important to understand that in any multi-section upright of four or more upright sections using this invention, the asymmetric cylinder assembly should be located such that it projects at least partially, and preferably substantially or wholly, into the previously defined area of intereference by the adjacent side of the upright and into the longitudinal plane of that side of the upright. It will be noted that this is the case even in the FIG. 7 modification wherein the asymmetric cylinder assembly and associated sprocket and chain structure are substantially spread out transversely of the upright in comparison with the structure of the preferred embodiment.

Although I have illustrated only certain embodiments of my invention, it will be understood by those skilled in the art that modifications may be made in the structure, form, and relative arrangement of parts without departing from the spirit and scope of the invention. Accordingly, I intend to cover by the appended claims all such modifications which properly fall within the scope of my invention.

I claim:

1. In an upright structure for lift trucks and the like having a fixed upright section including transversely spaced vertical rails, first, second and third telescopic upright sections each including transversely spaced vertical rails mounted for elevation relative to each other, the improvement comprising a sole asymmetric lift cylinder means mounted in the upright structure which is operatively connected to said first, second and third telescopic sections, said operative connection including elongated flexible lifting structure operatively connected to said lift cylinder and to said first, second and third telescopic sections, a first portion of said flexible lifting structure having one end structure thereof secured a substantial distance outwardly of one side only of the lift cylinder in a direction which includes a lateral component and having the other end structure thereof secured to one of said telescopic sections and a second portion of said flexible lifting structure being connected to the other two of said telescopic sections, said lift cylinder together with said flexible lifting structure being adapted to elevate said third section relative to said second section, said second section relative to said first section and said first section relative to said fixed section, the lift cylinder being located a substantial distance toward one lateral side of the upright structure such that it projects at least partially into the area of interference by an adjacent vertical rail with the visibility of the operator from his normal line of sight through said adjacent vertical rail, said normal line of sight being defined when the operator is located in a predetermined designed position and attitude for normal operation of the lift truck.

2. An upright structure as claimed in claim 1 wherein said first portion of said flexible lifting structure is reeved on first and second wheel elements operatively connected to said asymmetric lift cylinder, said first and second wheel elements being mounted in substantial longitudinal rotating alignment and spaced relation one to the other, said lift cylinder being located intermediate of said first and second wheel elements and of said one and other end structures of said flexible structure such that the lifting force of said lift cylinder is located at approximately two-thirds of the projected distance between said one and other end structures in a direction outwardly of said other end structure.

3. An upright structure as claimed in claim 1 wherein said cylinder assembly is located intermediate the central longitudinal plane of the third telescopic section and the said one end structure of the flexible lifting structure, said one end structure comprising a pair of anchor means for said flexible lifting structure, the projected or transverse distance from said central plane of the telescopic section to the axis of the cylinder assembly being approximately equal to one-third of the sum of the projected or transverse distances from the said central plane to the said pair of anchor means.

4. An upright structure as claimed in claim 1 wherein said first portion of the flexible lifting structure comprises first and second flexible lifting elements reeved on first and second wheel elements and operatively connected to said lift cylinder, the one ends of the lifting elements comprising said one end structure and the other ends of the lifting elements comprising said other end structure, said other end of the first lifting element being secured to said one telescopic section adjacent the adjacent side of the upright and the said other end of the second lifting element being secured to said one telescopic section adjacent the opposite side of the upright.

5. An upright structure as claimed in claim 4 wherein said lift cylinder is located intermediate said one and other end structures of said first portion of the flexible lifting structure in such a manner that the lifting force of said lift cylinder is applied at approximately one-third of the sum of the projected distances between the central vertical plane of said second telescopic section and said one ends of the lifting elements in a direction outwardly of said central plane.

6. An upright structure as claimed in claim 1 wherein said lift cylinder projects at least partially into the longitudinal plane of an adjacent vertical rail on the said one side of the upright structure.

7. An upright structure as claimed in claim 1 wherein the location of said lift cylinder is such that it projects a distance into the longitudinal plane of an adjacent vertical rail which is at least equal to the diameter of the cylinder.

8. An upright structure as claimed in claim 1 wherein said lift cylinder is located approximately two-thirds of the projected distance between said one and other end structures of said first portion of the flexible lifting structure in a direction outwardly of said other end structure.

9. An upright structure as claimed in claim 1 wherein a load carriage is mounted for elevation relative to said third telescopic section, a second lift cylinder assembly is adapted to elevate said load carriage relative to said third telescopic section, and an inverted U-shaped conduit connects hydraulically the base ends of the asymmetric and second lift cylinder assemblies, said conduit being supported from the upper end portion of one of said telescopic sections.

10. An upright structure as claimed in claim 1 wherein said lift cylinder is located intermediate said one and other end structures of said first portion of the flexible lifting structure in such a manner that the lifting force of said lift cylinder is applied at approximately two-thirds of the projected distance between said one and other end structures in a direction outwardly of said other end structure.

11. An upright structure as claimed in claim 1 wherein said second portion of said flexible lifting structure comprises first and second flexible lifting elements mounted independently from first and second transversely spaced wheel elements which are supported from said second telescopic section, the one ends of said flexible lifting elements being connected to one of said telescopic sections and the other ends of said flexible lifting elements being connected to another of said telescopic sections.

12. An upright structure as claimed in claim 11 wherein said first portion of said flexible lifting structure comprises a single flexible lifting element mounted from a pair of transversely spaced wheel elements, said other end structure thereof being connected to said second telescopic section.

13. An upright structure as claimed in claim 11 wherein said first portion of said flexible lifting structure comprises a first flexible lifting element mounted from a pair of transversely spaced wheel elements, one end of said flexible lifting element being secured substantially outwardly of the one side of the cylinder assembly and the other end thereof being secured to said one telescopic section at a location adjacent the opposite side of the upright.

14. An upright structure as claimed in claim 13 wherein a member extends transversely of the upright between the vertical rails of said first telescopic section, said pair of spaced wheel elements being supported from opposite side portions of said latter member.

15. An upright structure as claimed in claim 1 wherein first wheel means is supported from said second telescopic section, said second portion of said flexible lifting structure being reeved on said first wheel means the ends of which are connected to said first and third telescopic sections, and second wheel means supported from said first telescopic section, said first portion of said flexible lifting structure being reeved on said second wheel means and connected between said fixed upright section and said second telescopic section.

16. An upright structure as claimed in claim 15 wherein said second portion comprises two flexible lifting elements reeved on first and second wheel elements of said first wheel means and connected to said third telescopic section.

17. An upright structure as claimed in claim 15 wherein said second portion of said flexible lifting structure is connected centrally of said third telescopic section and said first portion of said flexible lifting structure comprises a single flexible lifting element connected to said second telescopic section at a location substantially in the longitudinal central vertical plane of said first wheel means.

18. An upright structure as claimed in claim 15 wherein a load carriage is mounted for elevation relative to said third telescopic section, a second lift cylinder is adapted to elevate said load carriage relative to said third telescopic section, said first and second portions of said flexible lifting structure having the inner portions thereof extending generally in the vertical longitudinal plane of said second cylinder assembly.

19. An upright structure as claimed in claim 18 wherein said second portion comprises first and second flexible lifting elements reeved on first and second wheel elements of said first wheel means, and said first portion comprises a single flexible lifting element reeved on first and second other wheel elements of said second wheel means.

20. An upright structure as claimed in claim 18 wherein a sheave is mounted adjacent said first wheel means, and an inverted U-shaped hydraulic conduit means is reeved from said sheave for connecting said asymmetric and second lift cylinders, the inner conduit portion of said conduit means being generally in the longitudinal vertical plane of said inner portions of said first and second portions of said flexible lifting structure.

21. An upright structure as claimed in claim 1 wherein a member extends transversely of the upright on a bias to the upright between the vertical rails of said first telescopic section providing a relatively wide end portion on one side thereof and a relatively narrow end portion at the other side thereof.

* * * * *

UNITED STATES PATENT AND TRADEMARK OFFICE

CERTIFICATE OF CORRECTION

PATENT NO. : 4,401,191

DATED : August 30, 1983

INVENTOR(S) : Richard J. Bartow

It is certified that error appears in the above-identified patent and that said Letters Patent is hereby corrected as shown below:

Column 1, line 57, after "secured" insert -- a substantial distance --; Column 5, line 56, "with" should read -- the --; Column 7, line 62, "volts" should read -- bolts --; Column 8, line 32, "support" should read -- supported --.

The title page should be deleted to appear as per attached title page.

Cancel all sheets of drawings and substitute the attached sheets therefore.

Signed and Sealed this

*Twenty-eighth* Day of *August 1984*

[SEAL]

*Attest:*

GERALD J. MOSSINGHOFF

*Attesting Officer* *Commissioner of Patents and Trademarks*

United States Patent [19]

Bartow

[11] 4,401,191

[45] Aug. 30, 1983

[54] UPRIGHT FOR LIFT TRUCK

[75] Inventor: Richard J. Bartow, Athens, Mich.

[73] Assignee: Clark Equipment Company, Buchanan, Mich.

[21] Appl. No.: 176,742

[22] Filed: Aug. 11, 1980

Related U.S. Application Data

[63] Continuation of Ser. No. 28,291, Apr. 9, 1979, abandoned, which is a continuation-in-part of Ser. No. 17,779, Mar. 8, 1979, abandoned, which is a continuation-in-part of Ser. No. 842,765, Oct. 17, 1977, abandoned.

[51] Int. Cl.[3] ..... B66B 9/20

[52] U.S. Cl. ..... 187/9 E; 414/631

[58] Field of Search ..... 187/9 R, 9 E, 9 T; 414/629, 631, 641, 635, 785

[56] References Cited

U.S. PATENT DOCUMENTS 3,394,778 7/1968 Brinton ..... 187/9 E 3,830,342 8/1974 Allen ..... 187/9 E

FOREIGN PATENT DOCUMENTS 2020276 11/1971 Fed. Rep. of Germany ..... 187/9 R

OTHER PUBLICATIONS

Robinson; "Double Asymmetric Upright".

*Primary Examiner*—Joseph J. Rolla

*Assistant Examiner*—Kenneth Noland

*Attorney, Agent, or Firm*—J. C. Wiessler

[57] ABSTRACT

A truck upright sections, and a load carriage mounted on a telescopic upright section. A sole asymmetric lift cylinder assembly is located adjacent one side of the upright in a position which provides improved overall operator visibility through the upright. The lift cylinder is adapted to be operatively connected at its upper end to a first telescopic upright section for operating first lifting chain structure which traverses laterally across the upright and which is reeved on spaced and rotationally aligned sprockets supported from said telescopic section. The first lifting chain structure in all embodiments comprising either single or multiple chains has one chain end(s) fixedly secured a substantial distance outwardly of one side only of the cylinder assembly to a member, such as to the adjacent outer upright rail, and the other chain end(s) secured to the second telescopic section either centrally thereof or at opposite sides thereof.

A third telescopic upright section on which is mounted the load carriage is itself mounted for elevation relative to the second telescopic section. Second lifting chain structure is also adapted to traverse laterally across a portion of the upright and is supported from the second telescopic section by sprocket means and is reeved thereon such that one chain end structure is secured to the third telescopic section and the other chain end structure is connected to the first telescopic section. A second lift cylinder is mounted centrally of the third section for elevating thereon a load carriage to a full free-lift position.

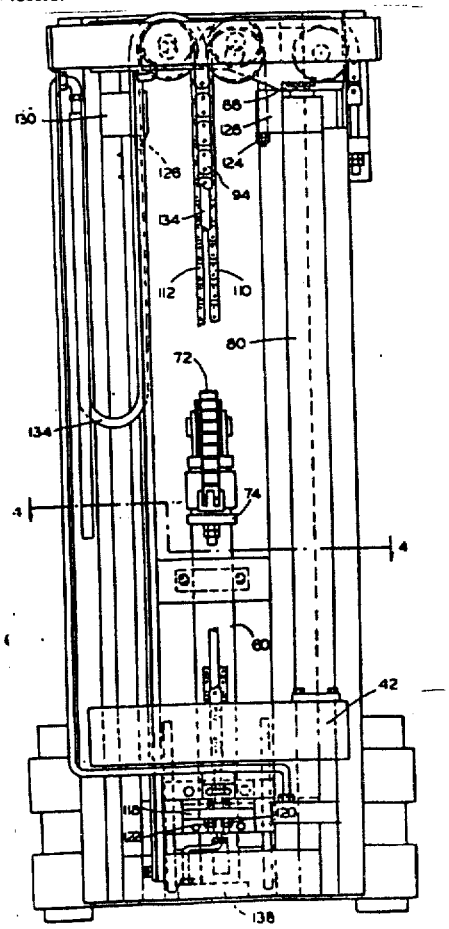

21 Claims, 15 Drawing Figures